US009653792B2

(12) United States Patent
Dai

(10) Patent No.: US 9,653,792 B2
(45) Date of Patent: May 16, 2017

(54) WINDOW ANTENNA LOADED WITH A COUPLED TRANSMISSION LINE FILTER

(71) Applicant: David Dai, Novi, MI (US)

(72) Inventor: David Dai, Novi, MI (US)

(73) Assignee: Pittsburgh Glass Works, LLC, Pittsburgh, PA (US)

( * ) Notice: Subject to any disclaimer, the term of this patent is extended or adjusted under 35 U.S.C. 154(b) by 0 days.

(21) Appl. No.: 14/171,070

(22) Filed: Feb. 3, 2014

(65) Prior Publication Data

US 2015/0222010 A1 Aug. 6, 2015

(51) Int. Cl.

| | |
|---|---|
| ***H01Q 1/32*** | (2006.01) |
| ***H01Q 1/50*** | (2006.01) |
| ***H01Q 1/12*** | (2006.01) |
| ***H01Q 9/30*** | (2006.01) |

(52) U.S. Cl.
CPC ..... *H01Q 1/50* (2013.01); *H01Q 1/1271* (2013.01); *H01Q 9/30* (2013.01)

(58) Field of Classification Search
CPC ... H01Q 1/1271; H01Q 9/0407; H01Q 1/2283
USPC ..... 343/803, 175, 834, 715, 713, 711
See application file for complete search history.

(56) References Cited

U.S. PATENT DOCUMENTS

| | | | | |
|---|---|---|---|---|
| 5,610,618 | A | 3/1997 | Adrian et al. | |
| 5,898,407 | A | 4/1999 | Paulus et al. | |
| 5,926,141 | A | 7/1999 | Lindenmeier et al. | |
| 5,999,136 | A | 12/1999 | Winter et al. | |
| 6,020,855 | A | 2/2000 | Nagy et al. | |
| 6,097,345 | A | 8/2000 | Walton | |
| 6,384,790 | B2 | 5/2002 | Dishart et al. | |
| 7,119,751 | B2 | 10/2006 | Li et al. | |
| 7,190,316 | B2 | 3/2007 | Yegin et al. | |
| 7,456,796 | B2 | 11/2008 | Nagayama et al. | |
| 7,675,471 | B2 | 3/2010 | Yegin et al. | |
| 7,960,854 | B2 | 6/2011 | Paulus et al. | |
| 8,009,107 | B2 * | 8/2011 | Li et al. | 343/700 MS |
| 8,077,100 | B2 * | 12/2011 | Baranski | 343/713 |
| 8,330,663 | B2 | 12/2012 | Noguchi et al. | |
| 8,810,462 | B2 * | 8/2014 | Goldberger | 343/713 |
| 8,872,703 | B2 * | 10/2014 | Degen et al. | 343/700 MS |
| 8,940,117 | B2 * | 1/2015 | Slafer | 156/219 |
| 2012/0098716 | A1 | 4/2012 | Dai | |
| 2012/0154229 | A1 | 6/2012 | Kagaya et al. | |

* cited by examiner

*Primary Examiner* — Peguy Jean Pierre
(74) *Attorney, Agent, or Firm* — Cohen & Grigsby, P.C.

(57) ABSTRACT

A window antenna wherein a silver ceramic trace is printed on an interior ply, and a connector is attached to the trace and a signal input. A length of the embedded antenna wire is oriented parallel to a coextensive length of the trace to form a coupled pass band filter. The coupled pass band filter provides a convenient feed to the antenna wire and eliminates a connection that extends from the edge of the laminate.

39 Claims, 9 Drawing Sheets

WINDOW ANTENNA LOADED WITH A COUPLED TRANSMISSION LINE FILTER

TECHNICAL FIELD

The present invention generally relates to vehicle antennas, and more specifically to window antennas wherein silver ceramic ink is screen printed on a surface of a glazing of a window laminate and/or, alternatively, by laying fine wires on a surface of the interlayer of the laminated glazing.

BACKGROUND OF THE INVENTION

In the prior art, as an alternative to standard whip antennas and roof mount mast antennas, automotive concealed window antennas have used silver printed antennas in the vehicle glazing. More recently, embedded wire antennas of quarter or half wavelength have been used in laminated windshields and back windows. Traditionally, antenna windshields have included a wire that is embedded in an interlayer of polyvinyl butyral that is sandwiched between a pair of glass sheets. A galvanized, flat cable connector connected the wire antenna to the vehicle electronic module. Before lamination, one end of the connector was soldered to an end of the antenna wire on the interlayer. The other end of the connector extended from the edge of the laminated glazing to provide a connection in the antenna module. The use of the flat connector generally required the use of relatively expensive prepress equipment to de-air the glass assembly before the window was autoclaved.

Several antenna designs have used coupling feeds to eliminate a connector that extends from the edge of the glass laminate. U.S. Pat. No. 8,077,100 B2 titled "Antenna Connector" from Pilkington discloses an antenna coupling apparatus to transfer the antenna signal from an antenna wire situated inside laminated glass to a connector on an exterior surface of the glass. A portion of the antenna wire is configured in different shapes to form a coupling region. The wire capacitively couples to a conductor surface that is connected to an antenna feeding cable. The coupling region and surface contact forms a two-line transmission line that transfers RF signals received by the antenna to the surface contact. U.S. Patent Application No. US 2010/0266832 A1 titled "Wired Glazing" from Pilkington discloses a rain sensor antenna that uses an inductively coupled coil to couple electrical current from a wire antenna located within the glazing to an electrical device on the exterior of the glazing. Neither of those designs provide an antenna that covers wide bandwidth such as TV VHF bands (47 MHz-240 MHz) and TV UHF band (470 MHz-860 MHz).

With the rapid growth in the demand for vehicle electronics, more and more antennas are being integrated to the vehicle. Particularly at FM and TV frequencies, antenna systems require multiple antennas to provide diversity operation that overcomes multipath and fading effects. In most cases, separate antennas and antenna feeds are used to meet those demands. Therefore, there was a need in the prior art for an antenna, particularly a coupling feed wire antenna, that is capable of supporting multiple frequency bands that serve different applications. Furthermore, there was a need in the prior art for an improved coupling of a wire antenna with multiband characteristics, good performance, and lower cost by eliminating a connector that extends from the edge of the glass laminate.

SUMMARY OF THE INVENTION

The presently disclosed invention includes an antenna window that has an outer glass ply, a plastic interlayer, a thin antenna conductor such as an electrically conductive paste or a wire adhered to or embedded in the interlayer, an inner glass ply, and a printed silver ceramic line on the interior surface of the inner ply. A galvanized connector that is soldered to the silver line on the surface of the inner ply is connected to a coaxial cable or other antenna module input. The silver line is printed within a black paint band that is located at the perimeter of the glass laminate such that it is not visible to occupants of the vehicle. The embedded wire is principally located in the daylight area of the glazing. A portion of the embedded wire lies parallel to and closely proximate to the silver line to form a coupled transmission line band-pass filter. For a receiving antenna, the transmission line filter transfers the antenna signal from the wire situated inside the laminated glass to the silver line on the surface of the outer glass ply. When the antenna is transmitting, the antenna signal is transferred in the opposition direction from the silver line on the surface of the outer glass ply to the wire situated inside the laminated glass. The window wire antenna is loaded with a coupled transmission line filter that provides a convenient feed for the antenna and eliminates the need for a connector that extends from the edge of the glass laminate. The coupled transmission line filter affords cost savings and allows antenna tuning and impedance matching that improves the transfer efficiency of radio frequency energy.

The antenna behaves in the manner of a linear antenna that is loaded with a transmission line filter. A liner antenna produces an essentially travelling-wave distribution of current by establishing a resistance of suitable magnitude one-quarter wave length from the end of the antenna. The resistance loaded antenna has a very broad bandwidth and much weaker mutual coupling than a conventional linear antenna. When a coupled transmission line filter with impedance comparable to that of the resistor is substituted for the resistor, the antenna also has a travelling wave distribution of current up to the loading elements, and standing wave distribution of current from the loading elements to the end of the antenna. The radiation pattern of the loaded wire antenna can be represented as a superposition of fields that are produced by currents on three radiating elements: an input section, a filter section, and an end section. The input section has a travelling-wave distribution of current that decays very slowly, the quarter-wavelength end section has a standing-wave distribution of current that has a magnitude that is approximately sinusoidal and decreases to zero at its end. The filter section is a more complex combination of even- and odd-mode excitations.

For multiband antenna design with wider bandwidth, a filter having more than one section of coupled lines may be required. The location and line length of the loading wires for each frequency band are selected such that the loading elements provide strong in-band coupling and high out-of-band isolation. By using multiple loading elements, the antenna resonate frequency and the number of frequency bands are adjustable so as to reduce the number of antennas on the vehicle and simplify the antenna and associated electronics design The antenna element printed on the surface of the inner ply has relatively low radiation resistance and narrow bandwidth because it's close to ground. The coupled line loading can increase the antenna bandwidth and efficiency to improve antenna gain and performance.

BRIEF DESCRIPTION OF THE DRAWINGS

For a more complete understanding of the presently disclosed invention, reference should now be had to the embodiments illustrated in greater detail in the accompanying drawings and described below by way of examples of the invention. In the drawings.

DETAILED DESCRIPTION OF THE INVENTION

Figure 1:
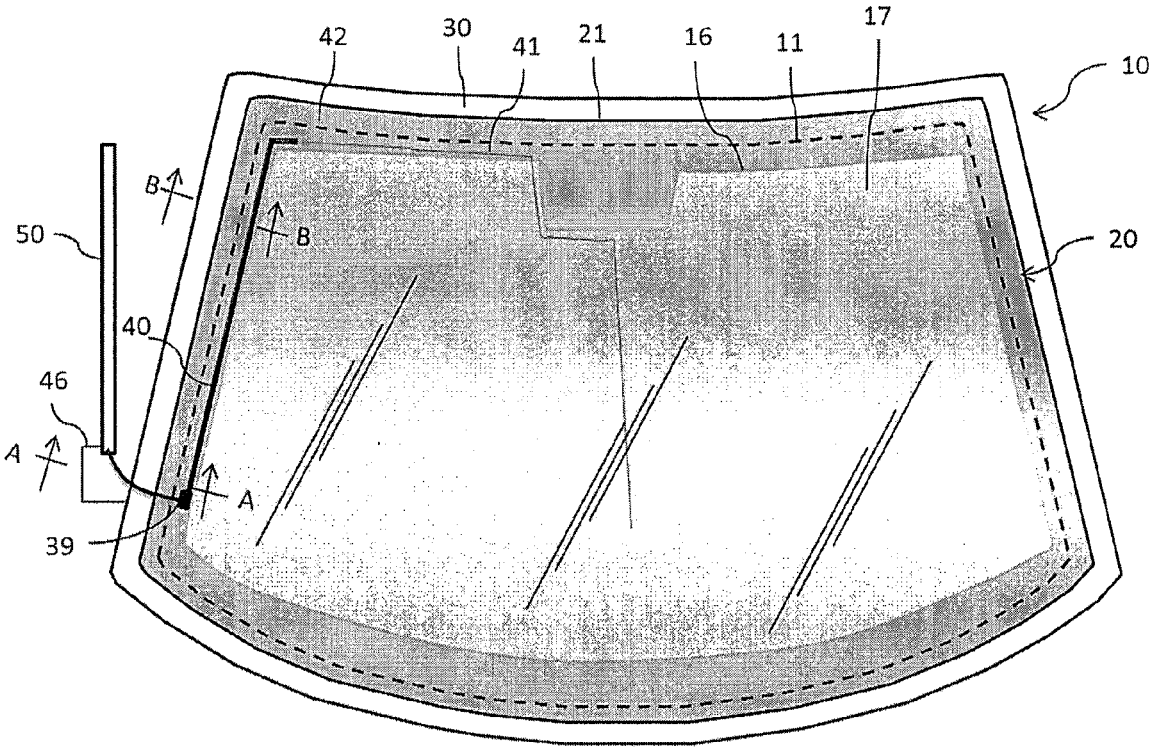
FIG. 1 is a plan view of an antenna windshield that incorporates features of the presently disclosed invention.
Figure 2:
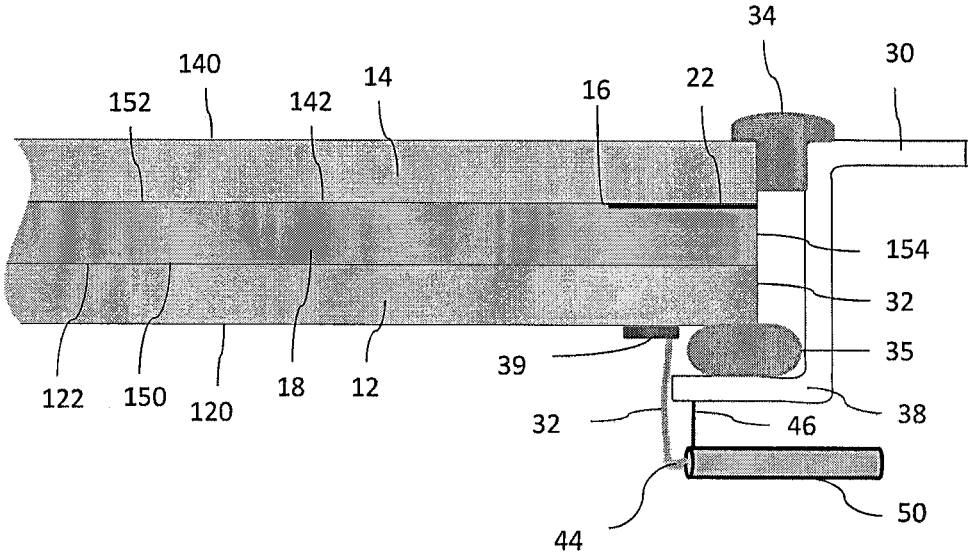
FIG. 2 is sectional view taken along line A-A in FIG. 1.
Figure 3:
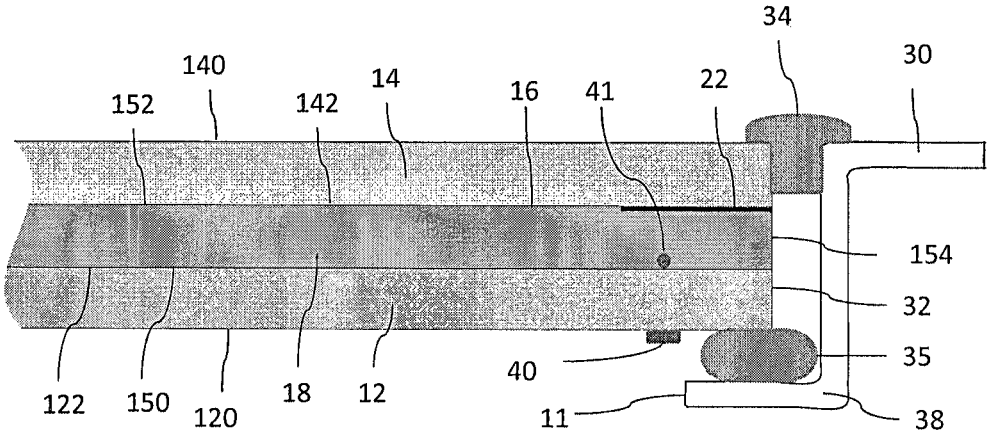
FIG. 3 is sectional view taken along line B-B in FIG. 1.

FIG. 1 is a plan view of the antenna windshield 10 and its associated structure incorporating features of the presently disclosed invention. FIG. 2 is a partial cross-section of FIG. 1 taken along the line A-A of FIG. 1. FIG. 3 is a partial cross-section of FIG. 1 taken along the line B-B of FIG. 1. FIGS. 1, 2 and 3 show that windshield 20 is surrounded by a metal frame with a body 30 having a window edge 11 that defines a window aperture. The outer edge 21 of windshield 20 overlaps the annular flange 38 of body 30 to mount windshield 20 in body 30. As shown in FIG. 2, the sectional view taken along line A-A in FIG. 1 shows an annular sealing member 35 that is placed between window glass 20 and flange 38. FIG. 2 also shows a molding 34 that bridges the outer gap between the body 30 and windshield 20. The window assembly includes an inner transparent ply 12 that has first and second oppositely disposed surfaces 120 and 122 respectively, The window assembly also includes an outer transparent ply 14 that has first and second oppositely disposed surfaces 142 and 140 respectively. An interlayer 18 is located between the second surface 122 of the inner transparent ply 12 and the first surface 142 of the outer transparent ply 14, An antenna wire 41 that has first and second longitudinal ends is embedded in one surface of interlayer 18. The window assembly includes an opaque coating such as black paint band 22 that covers a portion of the outer transparent ply adjacent the perimeter edge of the outer transparent ply 14. Antenna wire 41 is preferably coated with dark colored coating to minimize the visibility of the wire within the daylight opening of the window. Antenna wire 41 typically has a center core that is in the range 30 μm to 150 μm. Preferably, antenna wire 41 has a center core that is in the range of 60 μm to 90 μm.

In addition, a high conductive antenna line 40 is made by screen printing silver onto the first surface 120 of the inner transparent ply 12. Preferably, the width of the antenna line 40 is in the range 1 mm to 15 mm and more preferably in the range of 3 mm to 8 mm. Also preferably, the conductive antenna line 40 is located opposite from the perimeter area of windshield 20 that is covered by the black paint band 22. This arrangement conceals the antenna feed line from passenger view. The conductive antenna feed line 40 is coextensive with a portion of the antenna wire 41 that includes one longitudinal end of the antenna wire. Antenna line 40 is oriented parallel to antenna wire 41. One end of antenna line 40 is connected to a conductive solder patch 39. As illustrated in FIG. 2, a copper foil 32 is galvanically connected to solder patch 39. Copper foil 32 is also connected to the center conductor 44 of coaxial cable 50 or other vehicle electronic device (not shown). Preferably copper foil 32 is covered by plastic tape so that it is isolated from contact with window body 30 and shorts out the radio signals. Cable ground 46 is connected to the window frame near the inner metal edge 11 of the window flange 38. Antenna line 40, antenna wire 41, and window frame 30 form a coupled transmission line filter as further explained in connection with FIGS. 4, 5 and 6.

Figure 4:
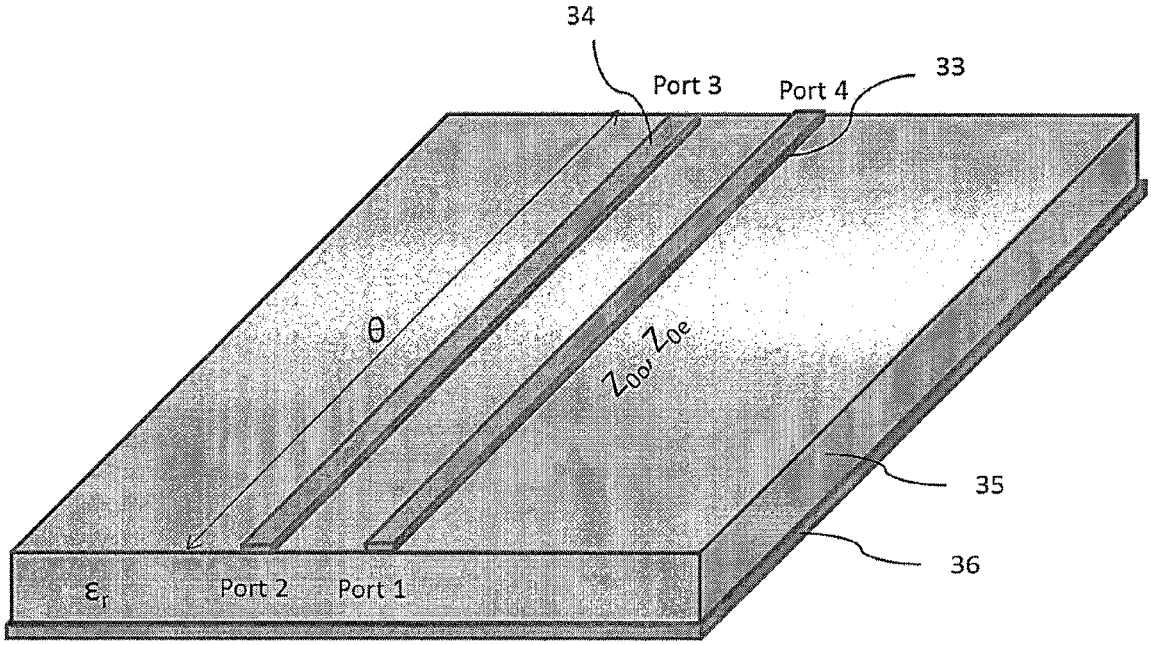
FIG. 4 shows an example of coupled transmission lines over a common ground plan.

FIG. 4 shows an example of two coupled transmission lines 33 and 34 over a common ground plane 36. Transmission lines 33 and 34 are isolated from ground plane 36 by an insulation layer 35 that has a dielectric constant $\in_r$. The electrical behavior of the two coupled transmission lines can be described by reference to an impedance matrix of a 4-port device. If the two transmission lines 33 and 34 are identical, there is a plane of circuit symmetry. As a result, odd/even mode analysis can be used to analyze the circuit and the impedance matrix of this four-port device has just four independent elements:

$$Z = \begin{bmatrix} Z_{11} & Z_{21} & Z_{31} & Z_{41} \\ Z_{21} & Z_{11} & Z_{41} & Z_{31} \\ Z_{31} & Z_{41} & Z_{11} & Z_{21} \\ Z_{41} & Z_{31} & Z_{21} & Z_{11} \end{bmatrix}$$

Where $$Z_{11} = -j(Z_{0e} + Z_{0o})\frac{\cot\theta}{2}$$

$$Z_{21} = -j(Z_{0e} + Z_{0o})\frac{\cot\theta}{2}$$

$$Z_{31} = -j(Z_{0e} + Z_{0o})\frac{\csc\theta}{2}$$

$$Z_{41} = -j(Z_{0e} + Z_{0o})\frac{\csc\theta}{2}$$

Where θ is the electrical length of the coupled wires;

$Z_{0e}$ is the characteristic impedance of one wire to ground in even mode;

$Z_{0o}$ is the characteristic impedance of one wire to ground in odd mode.

Figure 5:
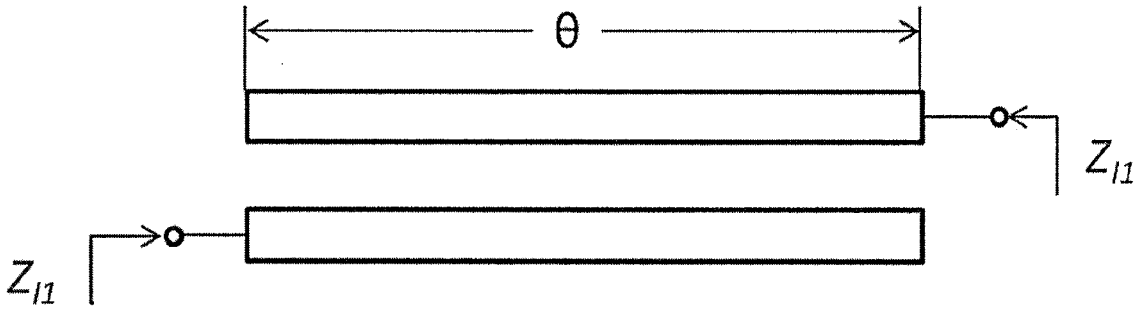
FIG. 5 shows a circuit model for the coupled transmission line filter shown in FIG. 4.

FIG. 5 is a schematic diagram of a transmission line filter. In the schematic diagram, the input output terminal pairs are designated by small open circles. The image impedance, $Z_{i1}$, as viewed looking into this terminal pair is also shown near the terminal pair. The definition of image impedance for a two-port network is the impedance, $Z_{i1}$, as viewed looking into port 1 when port 2 is terminated with the image impedance, $Z_{i2}$, for port 2. The image impedances of ports 1 and 2 are equal since the network shown in FIG. 5 is symmetrical with respect to the ports. Open-circuited terminal pairs of the coupled lines are shown with no connection in the filter schematic diagram. By applying the appropriate boundary conditions to the impedance matrix Z, the image impedance for this coupled transmission line filter can be written as:

$$Z_{I1} = \frac{[(Z_{0e} - Z_{0o})^2 - (Z_{0e} + Z_{0o})^2 \cos^2\theta]^{1/2}}{2\sin\theta} \text{ and}$$

$$\cos\theta_{c1} = -\cos\theta_{c2} = \left[\frac{\frac{Z_{0e}}{Z_{0o}} - 1}{\frac{Z_{0e}}{Z_{0o}} + 1}\right]$$

Figure 6:
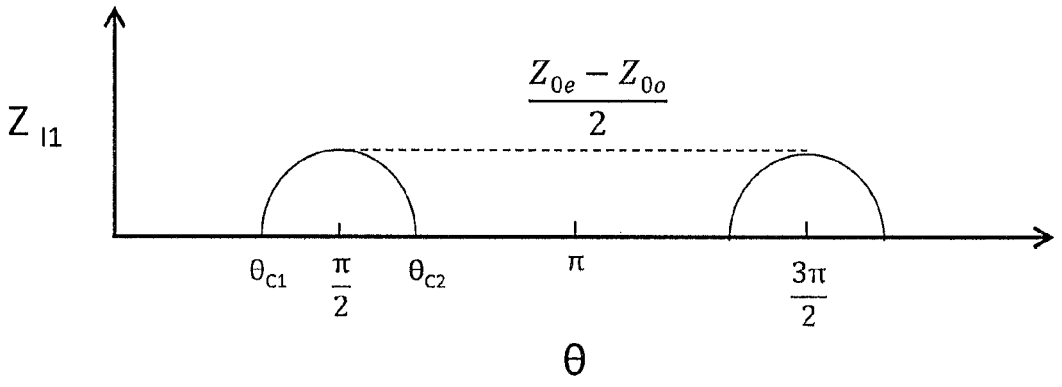
FIG. 6 shows an image impedance plot of the coupled transmission line filter.

FIG. 6 is a plot of the image impedance of the filter as a function of electrical length θ. It shows that the coupled line is a band-pass filter having a theoretically infinite number of pass bands that are centered about odd integer multiples of π/2.

Figure 7:
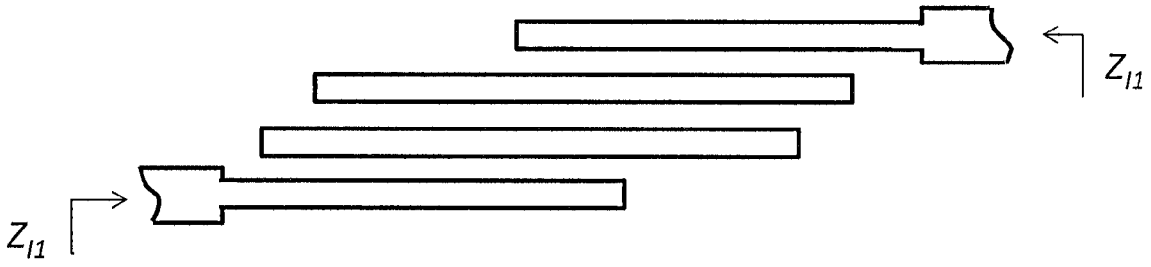
FIG. 7 shows a circuit model for a four-section coupled transmission line filter.

To achieve the desired performance from the filter, a cascade of several of the basic filter sections that are shown in FIG. 5 may be required. FIG. 7 illustrates a four-section band-pass filter in which the basic filter sections are cascaded. Where the input and output of basic sections occur at opposite ends of the lines, any number of sections may be cascaded.

The image impedance of the coupled transmission line filter is either higher or lower than the characteristic impedance of an isolated strip. Therefore, it is necessary to connect the filter to lines having different widths than the coupled lines in order to reduce the mismatch loss at the terminal. For example, when the image impedance of the filter is less than the characteristic impedance of an isolated line, the connecting line is made wider than the coupled line as illustrated for the filter in FIG. 7. When the image impedance of the filter is greater than the characteristic impedance of an isolated line, the connecting line is made narrower.

Figure 8:
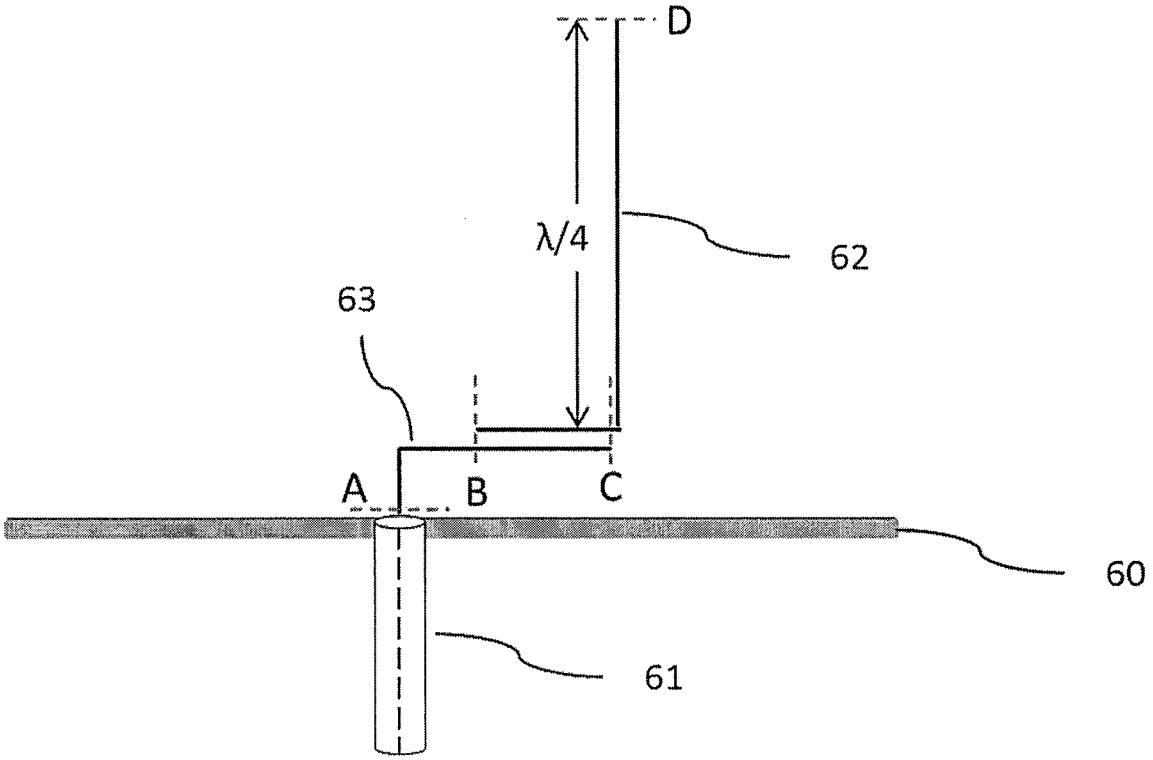
FIG. 8 shows a monopole antenna loaded with a coupled transmission line filter.

To further describe the preferred embodiment of the presently disclosed invention, an example of a simple monopole antenna that is loaded with the coupled transmission line filter is illustrated in FIG. 8. The monopole antenna comprises two "L" shaped conductors 62 and 63, a ground plane 60, and an antenna feed coaxial cable 61. The shield of coaxial cable 61 is connected to ground plane 60 while the center conductor of coaxial cable 61 is connected to end point A of conductor 63. The other end of conductor 63 and one end of conductor 62 coextend in parallel from point B to point C. The coupled portion from point B to point C of conductors 62, 63 and ground plane 60 forms a coupled transmission line band-pass filter. The vertical portion of conductor 62 from point C to point D is one-quarter wave length.

Travelling-wave linear antenna theory holds that a travelling-wave distribution of current can be produced on a linear antenna by inserting a resistance of suitable magnitude one-quarter wave length from the end of the antenna. An antenna that is resistance loaded in this way has a very broad bandwidth and has much weaker mutual coupling than a conventional linear antenna. When the resistor is replaced by coupled transmission line filter with impedance comparable to that of the resistor as illustrated in FIG. 8, the antenna also has a travelling wave distribution of current from point A to B on conductor 63 and standing wave distribution of current from point C to point D on conductor 62. The radiation pattern of the loaded monopole antenna can be represented as a superposition of fields that are produced by currents on three radiating elements: the input section (from point A to point B of conductor 63), the filter section (from point B to point C of conductors 62 and 63), and the end section (from point C to point D on conductor 62). The input section from A to B has a travelling-wave distribution of current which decays very slowly. The quarter-wavelength end section from C to D has a standing-wave distribution of current which has a magnitude that is approximately sinusoidal and decreases to zero at its end. The filter section from B to C has more complex current distributions since it's a combination of even- and odd-mode excitation.

Figure 9:
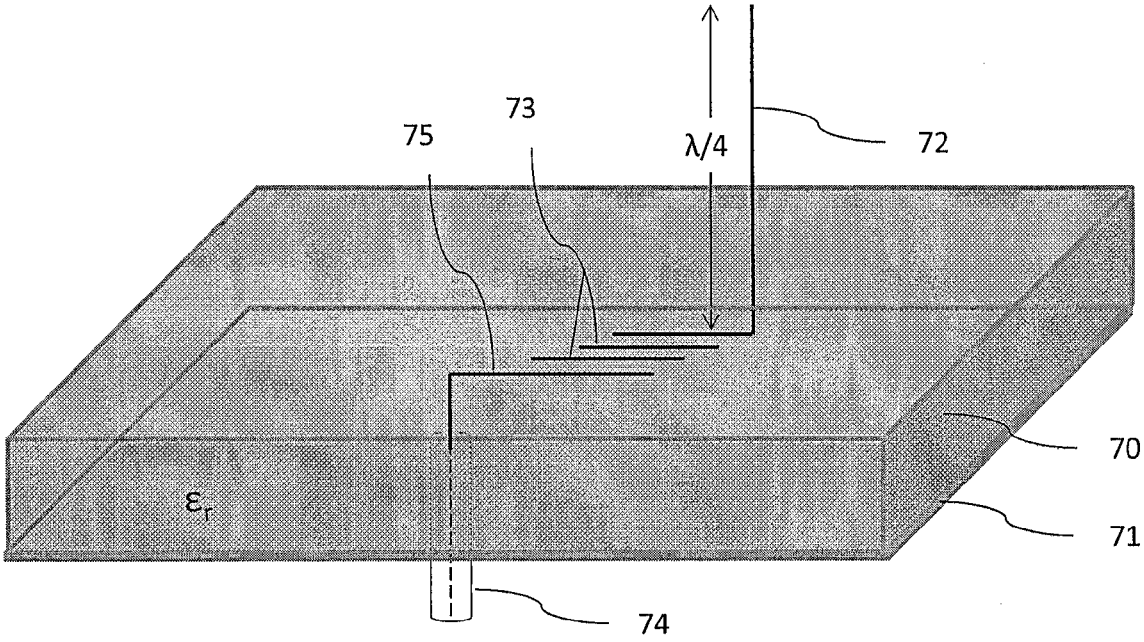
FIG. 9 shows a monopole antenna loaded with a coupled four-section transmission line filter.

To achieve a wider bandwidth and more uniform coupling response, it may be necessary to cascade several of the basic filter sections that are illustrated in FIG. 5. FIG. 9 illustrates a monopole antenna that is loaded with a four-section band-pass filter by cascading the basic filter sections. When one of more coupled transmission lines are added to the filter, each additional coupled transmission line is of the same length, but they are longitudinally positioned to be offset with respect to each other. More specifically, each additional coupled transmission line is offset with respect to an adjacent coupled transmission line such that the coupled transmission lines collectively form a cascaded array. At one end of the filter, each member of the array extends longitudinally beyond an adjacent member in the array while at the opposite end of the filter the same member of the array is longitudinally shorter than the same adjacent member. The input and output of the cascaded filter sections occur at opposite ends on lines 72 and 75. All the coupled lines 73 are printed on the top surface of a substrate 70 with dielectric constant $\in_r$ over a ground plan 71. The vertical portion of conductor 75 is embedded in the substrate 70 while the quarter wavelength vertical portion of conductor 72 is in open air and connected to the filter terminal on the top surface of substrate 70.

Referring to FIG. 1, the glass window wire antenna can be viewed as a wire antenna that is loaded with a coupled transmission line band-pass filter. Antenna wire 41 is closely coupled to the antenna line 40 through the coextending portion of antenna wire 41 and antenna line 40 where they form a coupled transmission line filter. At a frequency band when the image impedance at the input of the coupled line filter is equal to the characteristic impedance of antenna line 40, the antenna will have a travelling wave distribution of current up to the transmission line filter from antenna feeding pad 39 on line 40 up to the coextending portion of antenna wire 41 and antenna line 40 (which form the coupled transmission line filter). The antenna will have a standing wave distribution of current beginning at the opposite end of the coextending portion of the antenna wire 41 and the antenna line 40 that forms the coupled transmission line filter, to the distal end of antenna wire 41. Accordingly, the radiation pattern of the loaded wire antenna can be represented as a superposition of fields produced by currents on three radiating elements: the input section of line 40 from antenna feed point 39 up to the filter terminal point that begins the coupled transmission line filter, the coupled transmission line filter where antenna line 40 and antenna wire 41 coextend in parallel relation, and the end section of antenna wire 41 from the terminal at the opposite end of the coupled transmission line filter from the antenna feed to the end of antenna line 41 in the daylight opening of the windshield 20. The input section has a travelling-wave distribution of current which decays very slowly, the end section has a standing-wave distribution of current which has a magnitude that is approximately sinusoidal and decreases to zero at its distal end. The filter section is more complex since it's a combination of even- and odd-mode excitation.

The coupled transmission line filter provides a convenient structure to transmit the antenna signal from an antenna wire that is situated inside a piece of laminated glass to a conductor on an exterior surface of the glass laminate. Specifically, it eliminates the need to have a connector that extends from the edge of the glass laminate. The added benefit of using articulated nip rollers as prepress could avoid significant manufacturing cost for wire antenna products that use complex antenna connectors.

The window wire antenna loaded with a coupled transmission line filter not only provides a convenient structure to feed the antenna, but also affords an opportunity for antenna tuning and impedance matching to maximize radio frequency energy transfer. The antenna feeding structure presents an impedance transfer into the wire antenna with its own impedances. The image impedance of the coupled transmission line filter can be designed to match the wire antenna impedance to the impedance of a coaxial cable or other input impedance of the electronic device which are often defined as 50Ω. Referring to FIG. 3, the image impedance of the filter is a function of relative permittivity $\in_r$ of glass plies 12, 14 and interlayer 18, the width of line 40, the diameter of wire 41, the spacing between line 40 and wire 41, the spacing between trace 40 and window frame 30, and the substrate thickness of glass plies 12, 14 and interlayer 18. These parameters can be adjusted to cause the image impedance of the coupled transmission line filter to match the wire antenna impedance.

Figure 10:
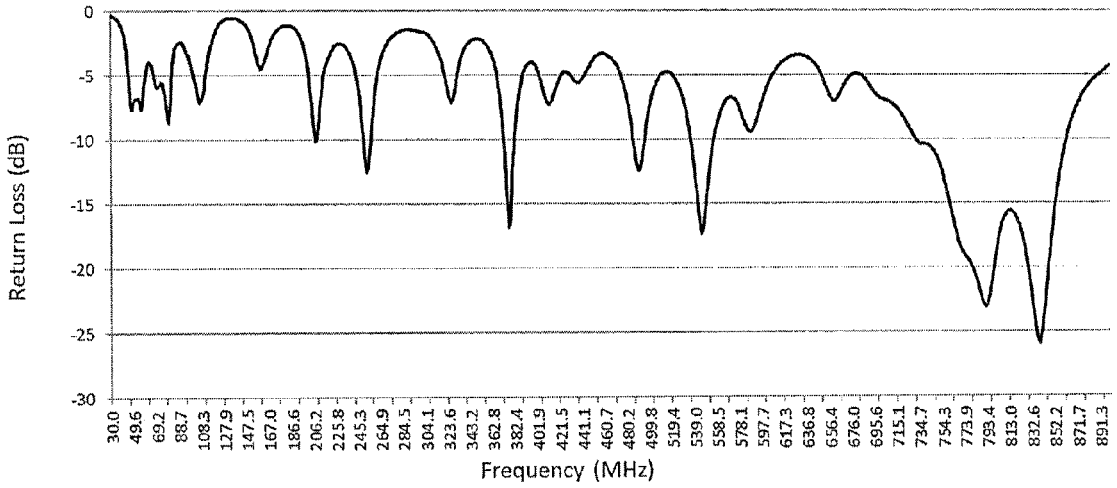
FIG. 10 is a plot of the antenna return loss illustrating the antenna resonant frequency bands from 30 to 900 MHz.

An embodiment similar to that illustrated in FIG. 1 was constructed and tested on a vehicle. FIG. 10 is the plot of the return loss (S11) of the slot antenna. From the power delivered to the antenna, return loss S11 is a measure of the power reflected from the antenna and the power "accepted" by the antenna and radiated. FIG. 10 shows that the antenna resonates well in multiple frequency bands from 47 MHz up to 900 MHZ. That frequency range covers TV band I (47-68 MHz), FM/TV band II (76-108 MHz), TV band III (174 MHz-230 MHz), digital audio broadcasting (DAB III) (174 MHz-240 MHz), Remote Keyless Entry (RKE) and tire pressure monitor system (TPMS) (433.92 MHz), TV band IV and V (474 MHz-860 MHz). Results of far-field gain measurements show that the antenna performs very well at all TV bands with equal or better antenna gain compared to traditional embedded wire or silver print window antennas. The wire antenna loaded with a transmission line filter demonstrates the capability for multi-band application that can reduce the number of antennas, simplify antenna amplifier design, and reduce overall costs for the antenna system.

Figure 11:
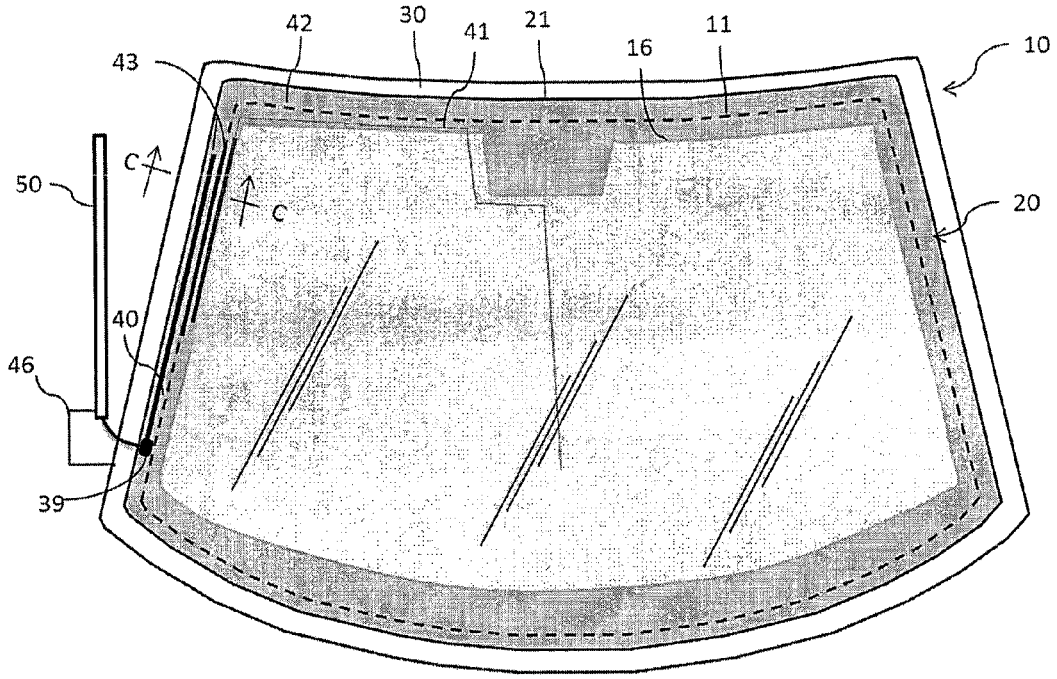
FIG. 11 is a plan view of a windshield antenna system with a four-section band pass filter.
Figure 12:
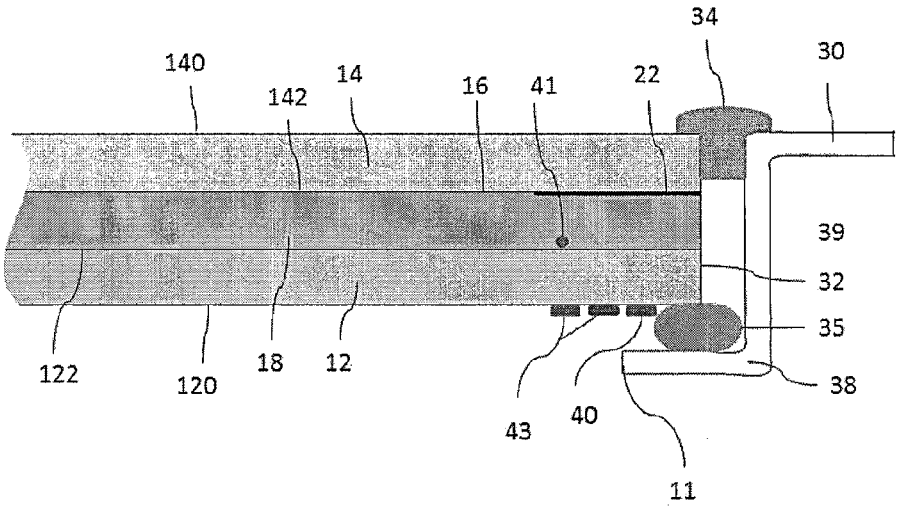
FIG. 12 is sectional view taken along line C-C in FIG. 11.

For multiband antenna design with wider bandwidth, cascading more than one basic filter sections may be necessary. FIGS. 11 and 12 illustrate an imbedded wire antenna that is loaded with a four-section band-pass filter by cascading the basic filter sections. Two additional coupled transmission lines 43 are printed on surface 120 under the black paint band 22. Wire 41, lines 43, 40, and window frame 30 form a four-section coupled transmission line filter. The multi-section filter provides greater flexibility for antenna tuning and impedance matching with possible wider bandwidth and flatter response for the filter.

Figure 13:
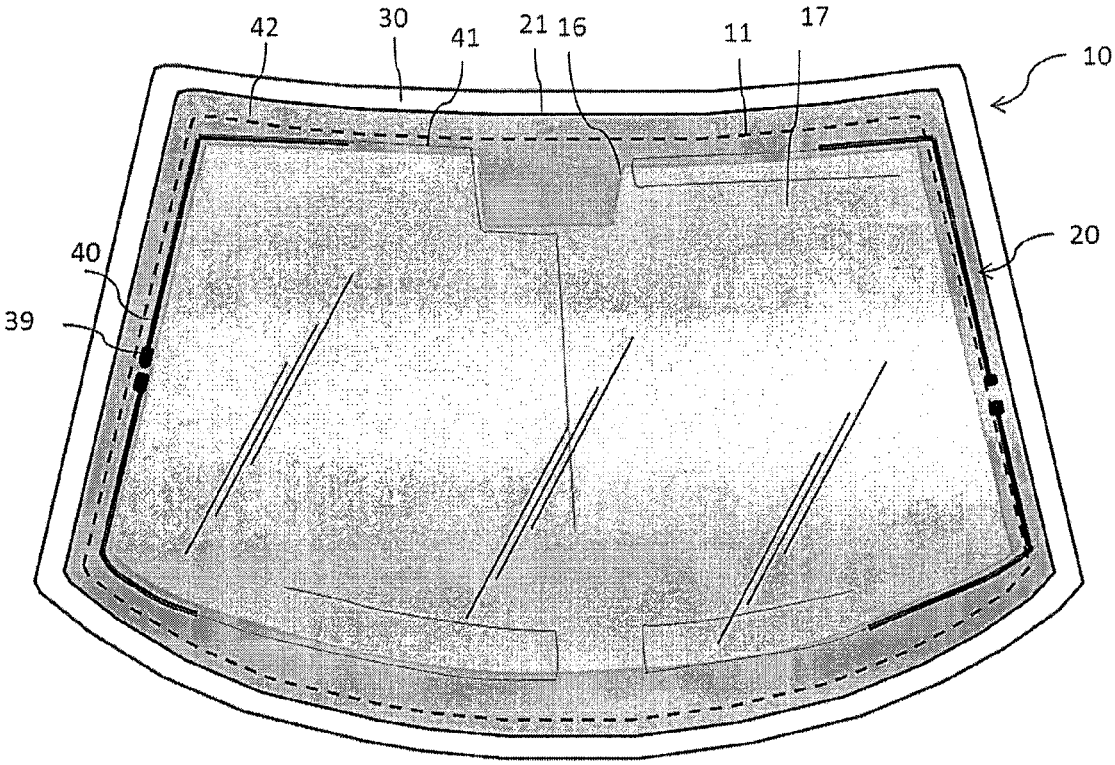
FIG. 13 is a plan view of a windshield wire antenna system with four separate antennas for diversity reception.

The embodiment of FIG. 13 represents a still further development in accordance with the presently disclosed invention. A plurality of antennas as herein disclosed can be located, arranged and fed at respective locations around a window opening to form a diverse antenna system that has respective antennas for different applications. As previously described herein, each of the antennas can be tuned to different respective frequency bands. FIG. 13 illustrates a four separate wire antennas loaded with four coupled transmission line filters incorporated into the windshield. Each antenna is fed independently by a printed line on the exterior surface at the A-pillars. The top two antennas are symmetrically located along two sides of the windshield. Since the two antenna feeds are at least λ/4 wavelength apart at FM and TV frequencies and are weakly coupled, both can be used simultaneously for FM and TV diversity antenna system. The same is true for the bottom two antennas which also can be used for FM diversity. Intentionally, antenna wires are spaced away from the third visor area to limit unwanted electromagnetic coupling between the antenna and vehicle electronics that are mounted near the rear view mirror such as an IR camera, night view camera, and rain sensor. Each antenna also can be tuned to resonate at different frequencies for a variety of automotive wireless applications.

While the disclosed invention has been described and illustrated by reference to certain preferred embodiments and implementations, it should be understood that various modifications may be adopted without departing from the spirit of the invention or the scope of the following claims.

What is claimed is:

1. An antenna for use in connection with a transparency that is mounted in an electrically conductive frame, said antenna comprising:

at least one transparent ply having oppositely disposed surfaces that are defined by an outer edge that is located between said oppositely disposed surfaces;

an interlayer having oppositely disposed surfaces that are defined by an outer edge located between said oppositely disposed surfaces, said interlayer being oriented such that one surface of said interlayer faces one surface of said transparent ply;

an antenna conductor that is located in said one surface of said interlayer that faces said one surface of said at least one transparent ply;

a conductive antenna feed line that is located on the surface of said transparent ply that is oppositely disposed from the surface of said transparent ply that faces said interlayer, at least a portion of said antenna feed line being aligned parallel to said antenna conductor and in proximity to said antenna conductor such that said parallel portions of said antenna conductor and said antenna feed line that are coextensive with each other cooperate with the electrically conductive frame to form a coupled transmission line filter, said coupled transmission line filter having an image impedance and said conductive antenna feed line having a width that is established in accordance with the width of the portion of said conductive antenna feed line that is coextensive with said antenna conductor to match said image impedance of the coupled transmission line filter.

2. The antenna of claim 1 wherein said electrically conductive frame is connected to an electrical ground.

3. The antenna of claim 2 wherein said conductive antenna feed line is connected to a conductor that carries a feed signal.

4. The antenna of claim 2 wherein the coextensive portions of said antenna feed line and said antenna conductor define a coupled transmission line filter having a first end and a second end, with said antenna conductor extending from said first end of said coupled transmission line filter and the conductive antenna feed line extending from the second end of said coupled transmission line filter.

5. The antenna of claim 4 wherein the conductor that carries the feed signal is connected to the portion of said antenna feed line that extends from the second end of said coupled transmission line filter.

6. The antenna of claim 5 wherein said coupled transmission line filter further includes at least one additional coupled transmission line that is located on the surface of said transparent ply that is oppositely disposed from the surface of said transparent ply that faces said interlayer, said additional coupled transmission line being aligned parallel to the portion of said antenna wire and the portion of said antenna feed line that are included in said coupled transmission line filter to form a multi-section filter.

7. The antenna of claim 5 wherein the image impedance of said coupled transmission line filter matches the characteristic impedance of said antenna feed line by selection of at least one of the relative permittivity of said transparent ply and said interlayer, the width of said conductive antenna feed, the diameter of said antenna conductor, the spacing between said conductive antenna feed and said antenna conductor, and the thickness of said transparent ply and said interlayer.

8. The antenna of claim 4 wherein the said conductive antenna feed line extending from the second end of said coupled transmission line filter is made wider than the portion of said conductive antenna feed line that is coextensive with said antenna conductor when the image impedance of the coupled transmission line filter is less than the characteristic impedance of an isolated line.

9. The antenna of claim 4 wherein the said conductive antenna feed line extending from the second end of said coupled transmission line filter is made narrower than the portion of said conductive antenna feed line that is coextensive with said antenna conductor when the image impedance of the coupled transmission line filter is greater than the characteristic impedance of an isolated line.

10. The antenna of claim 1 in combination with at least one other antenna also as claimed in claim 1 included in the same transparency.

11. The antenna of claim 1 wherein the said conductive antenna feed line is made wider than the portion of said conductive antenna feed line that is coextensive with said antenna conductor when the image impedance of the coupled transmission line filter is less than the characteristic impedance of an isolated line.

12. The antenna of claim 1 wherein the said conductive antenna feed line is made narrower than the portion of said conductive antenna feed line that is coextensive with said antenna conductor when the image impedance of the coupled transmission line filter is greater than the characteristic impedance of an isolated line.

13. An automotive window antenna comprising:

(a) a vehicle body formed in association with an electrically conducting metal member having an inner metal edge that defines a window opening;

(b) a window assembly that is fastened to said opening, said window assembly including:

an inner transparent ply that has first and second oppositely disposed surfaces, an outer transparent ply that has first and second oppositely disposed surfaces, an interlayer that is located between the second surface of said inner transparent ply and the first surface of said outer transparent ply, an antenna wire having first and second longitudinal ends, said antenna wire being embedded in one surface of said interlayer, and a conductive antenna feed line that is secured to the first surface of said inner transparent ply, a portion of said conductive antenna feed line being coextensive with and parallel to a portion of said antenna wire that includes one longitudinal end of said antenna wire to form a coupled transmission line filter with said antenna wire extending from a first end of said coupled transmission line filter and said conductive antenna feed line extending from a second end of said coupled transmission line filter, said coupled transmission line filter having an image impedance and said conductive antenna feed line that extends from the second end of said coupled transmission line filter having a width that is established in accordance with the width of the portion of said conductive antenna feed line that is included in said coupled transmission line filter to match said image impedance of the coupled transmission line filter;

(c) an antenna feed that is electrically connected to one end of said conductive antenna feed line; and (d) an electrical ground from the window assembly to the vehicle body.

14. An antenna as claimed in 13 wherein said antenna wire is preferably coated with dark colored coating to minimize visibility and wherein said antenna wire has a center core that is in the range 30 μm to 150 μm.

15. The antenna of claim 14 wherein said antenna wire has a center core that is in the range of 60 μm to 90 μm.

16. An antenna as claimed in 13 wherein said window assembly includes an opaque coating that covers a portion of said outer transparent ply adjacent the perimeter edge of the outer transparent ply and wherein said antenna feed line is made by screen printing silver onto the first surface of said inner transparent ply opposite said opaque coating to conceal said antenna feed line and wherein the width of said antenna line in the range 1 mm to 15 mm.

17. The antenna of claim 16 wherein the width of said antenna line is in the range of 3 mm to 8 mm.

18. An antenna as claimed in 13 wherein said the portions of said antenna wire, antenna feed line, and vehicle window frame that are coextensive define a coupled transmission line filter.

19. An antenna as claimed in 18 wherein said coupled transmission line filter is a band pass filter that has a plurality of pass bands centered about odd integer multiples of $\pi/2$ along the electrical length of the coupled transmission line filter.

20. An antenna as claimed in 18 wherein the coupled transmission line filter further includes elements that are oriented in a cascade arrangement to define a multiple-section band pass filter.

21. An antenna as claimed in claim 18 wherein the portion of said antenna wire and said antenna feed line that are not included in said coupled transmission line filter have widths that are different than the width of the portion of said antenna wire and said antenna feed that are included in said coupled transmission line filter to limit the mismatch loss at the terminals of said coupled transmission line filter at times when the image impedance of the filter is different than the characteristic impedance of an isolated antenna feed line.

22. A plurality of antennas as claimed in 13 wherein said antennas are located, arranged and fed at respective locations around the window opening to form a diverse antenna system having antennas for different applications.

23. The plurality of antennas of claim 22 wherein the antennas are tuned to different respective frequency bands.

24. The antenna of claim 13 wherein the said conductive antenna feed line extending from the second end of said coupled transmission line filter is wider than the portion of said conductive antenna feed line that is included in said coupled transmission line filter when the image impedance of the coupled transmission line filter is less than the characteristic impedance of an isolated line.

25. The antenna of claim 13 wherein the said conductive antenna feed line extending from the second end of said coupled transmission line filter is narrower than the portion of said conductive antenna feed line that is included in said coupled transmission line filter when the image impedance of the coupled transmission line filter is greater than the characteristic impedance of an isolated line.

26. An antenna for use in connection with a transparency that is mounted in an electrically conductive frame that is connected to an electrical ground, said antenna comprising:

at least one transparent ply having oppositely disposed surfaces that are defined by an outer edge that is located between said oppositely disposed surfaces;

an interlayer having oppositely disposed surfaces that are defined by an outer edge located between said oppositely disposed surfaces, said interlayer being oriented such that one surface of said interlayer faces one surface of said transparent ply;

an antenna conductor that faces the surface of said at least one transparent ply;

a conductive antenna feed line that is located on the surface of said transparent ply that is oppositely disposed from the surface of said transparent ply that faces said interlayer, at least a portion of said antenna feed line being aligned parallel to said antenna conductor and in proximity to said antenna conductor such that said parallel portions of said antenna conductor and said antenna feed line that are coextensive with each other cooperate with the electrically conductive frame to form a coupled transmission line filter having a first end and a second end, with said antenna conductor extending from said first end of said coupled transmission line filter and the conductive antenna feed line extending from the second end of said coupled transmission line filter;

a conductor that carries the feed signal and that is connected to the portion of said antenna feed line that extends from the second end of said coupled transmission line filter; and at least one additional coupled transmission line that is located on the surface of said transparent ply that is oppositely disposed from the surface of said transparent ply that faces said interlayer, said additional coupled transmission line being aligned parallel to the portion of said antenna wire and the portion of said antenna feed line that are included in said coupled transmission line filter to form a multi-section filter.

27. The antenna of claim 26 wherein each of said additional coupled transmission lines has a first longitudinal end and a second longitudinal end that is oppositely disposed from said first longitudinal end, the first longitudinal end of said additional coupled transmission line being offset from the longitudinal position at which said antenna conductor extends from said coupled transmission line filter and the second longitudinal end of said additional coupled transmission line being offset from the longitudinal position at which said conductive antenna feed extends from the coupled transmission line filter.

28. The antenna of claim 27 wherein said additional coupled transmission lines are arranged in a cascaded array.

29. The antenna of claim 26 having more than one additional coupled transmission line wherein each of said additional coupled transmission lines is of the same length, the longitudinal position of each of said additional coupled transmission lines being offset with respect to other additional coupled transmission lines such that the coupled transmission lines collectively form a cascaded array.

30. An automotive window antenna comprising:

(a) a vehicle body formed in association with an electrically conducting metal member having an inner metal edge that defines a window opening;

(b) a window assembly that is fastened to said opening, said window assembly including:

an inner transparent ply that has first and second oppositely disposed surfaces, an outer transparent ply that has first and second oppositely disposed surfaces, an interlayer that is located between the second surface of said inner transparent ply and the first surface of said outer transparent ply, an antenna wire having first and second longitudinal ends, said antenna wire being embedded in one surface of said interlayer, and a conductive antenna feed line that is secured to the first surface of said inner transparent ply, said conductive antenna feed line being coextensive with and parallel to a portion of said antenna wire that includes one longitudinal end of said antenna wire, a portion of said window opening being coextensive with said conductive antenna feed line that is secured to the first surface of said inner transparent ply and also coextensive with the portion of said antenna wire that includes one longitudinal end of said wire antenna to define a coupled transmission line filter that is a band pass filter that has a plurality of pass bands centered about odd integer multiples of $\pi/2$ along the electrical length of the coupled transmission line filter;

(c) an antenna feed that is electrically connected to one end of said antenna feed line; and (d) an electrical ground from the window assembly to the vehicle body.

31. An antenna as claimed in claim 30 wherein the antenna characteristics of said wire antenna are equivalent to the antenna characteristics of a monopole antenna that is loaded with the coupled transmission line band-pass filter.

32. An antenna as claimed in 31 wherein at times when the image impedance of said coupled transmission line filter is comparable to the characteristic resistance of the antenna line and is a quarter-wavelength from the distal end of said antenna wire, the antenna feed line has a travelling wave distribution of current up to the coupled transmission line filter, the quarter-wavelength end section of said antenna wire has a standing-wave distribution of current that has an amplitude that is approximately sinusoidal with a zero value at the distal end of the antenna wire and wherein the current distribution on the filter section is a combination of even-and odd-mode excitations.

33. An antenna as claimed in 31 wherein said the radiation pattern of said antenna is a superposition of fields that are produced by currents on the input section of said antenna feed line that is connected to the coupled transmission line filter, the coupled transmission line filter, and the quarter-wavelength end section of said antenna wire that extends beyond said coupled transmission line filter.

34. An antenna as claimed in 31 wherein said antenna wire is at least partially located within a laminate, said coupled transmission line filter transmitting the antenna signal from said antenna wire to a connector on the first surface of said inner transparent ply.

35. An antenna as claimed in 31 wherein said wire antenna loaded with a coupled transmission line filter transmits a frequency band from 47 MHz to 900 MHz.

36. The antenna of claim 35 wherein said wire antenna loaded with a coupled transmission line filter transmits a frequency band that includes FM, TV VHF, TV UHF, RKE, TPMS and DAB band III frequency bands.

37. An antenna as claimed in claim 30 wherein the coupled transmission line filter is designed to promote radio frequency energy transfer between said antenna wire and said antenna feed line.

38. An antenna as claimed in 37 wherein said the image impedance of said coupled transmission line filter is variable according to the relative permittivity $\in_r$ of said glass plies and said interlayer, the width of said antenna feed line, the diameter of said antenna wire, the spacing between said antenna feed line, the antenna wire, and the window frame, and the thickness of inner transparent ply, outer transparent ply, and the interlayer.

39. An automotive window antenna comprising:

(a) a vehicle body formed in association with an electrically conducting metal member having an inner metal edge that defines a window opening;

(b) a window assembly that is fastened to said opening, said window assembly including:

an inner transparent ply that has first and second oppositely disposed surfaces, an outer transparent ply that has first and second oppositely disposed surfaces, an interlayer that is located between the second surface of said inner transparent ply and the first surface of said outer transparent ply, an antenna wire having first and second longitudinal ends, said antenna wire being embedded in one surface of said interlayer, and a conductive antenna feed line that is secured to the first surface of said inner transparent ply, said conductive antenna feed line being coextensive with and parallel to a portion of said antenna wire that includes one longitudinal end of said antenna wire, a portion of said window opening being coextensive with said conductive antenna feed line that is secured to the first surface of said inner transparent ply and also coextensive with the portion of said antenna wire that includes one longitudinal end of said wire antenna to define a coupled transmission line filter, the portion of said antenna wire and said antenna feed line that are not included in said coupled transmission line filter having widths that are different than the width of the portion of said antenna wire and said antenna feed that are included in said coupled transmission line filter to limit the mismatch loss at the terminals of said coupled transmission line filter at times when the image impedance of the filter is different than the characteristic impedance of an isolated antenna feed line;

(c) an antenna feed that is electrically connected to one end of said antenna feed line; and (d) an electrical ground from the window assembly to the vehicle body.

* * * * *